US012129096B2

(12) United States Patent
Unterlechner et al.

(10) Patent No.: US 12,129,096 B2
(45) Date of Patent: Oct. 29, 2024

(54) ADAPTER FOR CONNECTING A REFILL CONTAINER

(71) Applicant: ALPLA Werke Alwin Lehner GmbH & Co. KG, Hard (AT)

(72) Inventors: Oliver Unterlechner, Bregenz (AT); Klemens Bösch, Lustenau (AT); Danilo Grieco, Feldkirch (AT); Daniel Schnetzer, Altach (AT)

(73) Assignee: ALPLA Werke Alwin Lehner GmbH & Co. KG, Hard (AT)

( * ) Notice: Subject to any disclaimer, the term of this patent is extended or adjusted under 35 U.S.C. 154(b) by 78 days.

(21) Appl. No.: 17/999,085

(22) PCT Filed: May 17, 2021

(86) PCT No.: PCT/EP2021/062981

§ 371 (c)(1),
(2) Date: Nov. 17, 2022

(87) PCT Pub. No.: WO2021/233821

PCT Pub. Date: Nov. 25, 2021

(65) Prior Publication Data

US 2023/0192387 A1 Jun. 22, 2023

(30) Foreign Application Priority Data

May 18, 2020 (CH) ..... 00594/20

(51) Int. Cl.
*B65D 81/32* (2006.01)
*B65D 71/50* (2006.01)

(52) U.S. Cl.
CPC ..... *B65D 81/3205* (2013.01); *B65D 71/502* (2013.01)

(58) Field of Classification Search
CPC ..... B65D 71/502; B65D 81/3205
USPC ..... 604/411; 141/329, 330
See application file for complete search history.

(56) References Cited

U.S. PATENT DOCUMENTS 4,614,437 A * 9/1986 Buehler ..... B01F 35/32021 215/390
5,131,566 A * 7/1992 Bavegems ..... B65D 47/06 141/330

FOREIGN PATENT DOCUMENTS

BE 534496 1/1955
EP 0 421 538 A1 4/1991
EP 3095728 A1 * 11/2016 ..... B65D 71/502
FR 1 420 585 12/1965

(Continued)

OTHER PUBLICATIONS

International Search Report Corresponding to PCT/EP2021/062981 mailed Aug. 2, 2021.

(Continued)

*Primary Examiner* — Timothy L Maust
(74) *Attorney, Agent, or Firm* — Finch & Maloney PLLC

(57) ABSTRACT

An adapter (100) for connecting a refill container (200) with a container (300) during a refilling process. The adapter (100) has a first open end (10) and a second open end (11). The first open end (10) and the second open end (11) are connected to an, in particular, peripheral wall (12). A breaking element (20) is arranged inside the adapter (100). The breaking element (20) extends in the direction of the first open end (10) and is connected on one side via a web (21) to the wall (12).

13 Claims, 3 Drawing Sheets

(56) References Cited

FOREIGN PATENT DOCUMENTS

GB 2 342 347 A 4/2000

OTHER PUBLICATIONS

Figure 1:
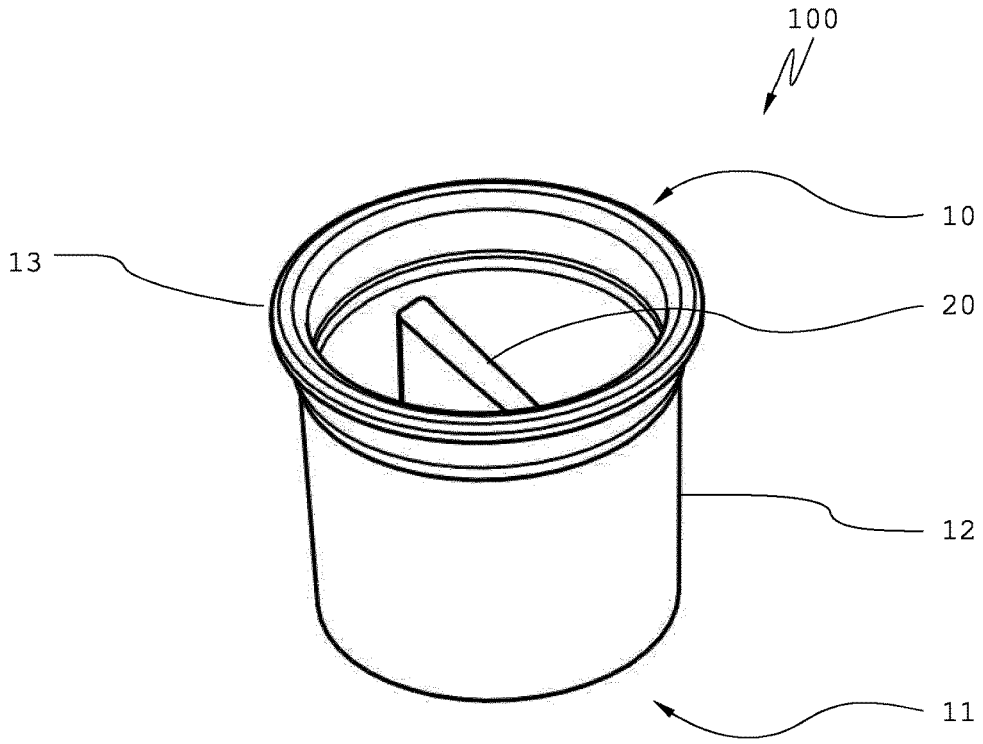

Written Opinion Corresponding to PCT/EP2021/062981 mailed Aug. 2, 2021.

* cited by examiner

ADAPTER FOR CONNECTING A REFILL CONTAINER

The present invention relates to an adapter for connecting a refill container to a container during a refilling process, according to the preamble of the independent claims.

Various devices and methods for refilling bottles or containers are known from the prior art. This need arises on the one hand in that containers of complex design are to be used repeatedly, and refill bottles or refill containers intended for single use, for example, must be of less stable design. In addition, there is a need to design packaging materials in such a way that resources are conserved. This also results, for example, in containers which are manufactured to be correspondingly stable so that they can be used again and again on a daily basis, and in refill containers which are manufactured from relatively thin materials and are provided only for single use. For example, refill containers can be manufactured in the form of pouches.

For example, a refill container which has a specific closure has been known from GB 2 342 347 A. This closure has a breakable wall which is broken open by screwing the refill container, together with the closure, onto the container to be refilled. This closure is complex to manufacture, has a high consumption of material, and can only be used once. If, for example, not all the liquid can be dispensed from the refill container into the container to be refilled, the refill container can no longer be closed. This is particularly disadvantageous if, for example, the refill container contains only a concentrate which must be diluted. Typically, such refill containers have a greater content than the container. The closure which is shown in GB 2 342 347 A connects the refill container to the container to be refilled. Due to the specific design of the closure, an emptying of the refilling container without residue is not possible.

Connecting nozzles, which are used to connect a refill container to the container to be refilled, are additionally known from the prior art. After the process, these are removed again so that the containers can respectively be closed again. After use, these connecting nozzles must either be disposed of or cleaned in a complicated manner so that they can be temporarily stored until their next use.

The refilling of containers is desired in particular if the container is provided with a pump system or spray system. These systems are relatively expensive in comparison to the container on which they are arranged. There is therefore a need to reuse these pump or spray systems.

These systems respectively have at least one suction or connection tube which leads into the interior of the container. Often, in the assembled state of the container, these suction or connection tubes are arranged eccentrically with respect to its dispensing opening. These systems are therefore either not compatible with the previously known refill systems, or the known refill systems must be removed and cleaned or disposed of after each refilling process.

It is therefore the object of the invention to remedy at least one or more disadvantages of the prior art. In particular, an adapter for connecting a refill container to a container during a refilling process is to be provided, which adapter is simple to manufacture, can be used multiple times, and thereby in particular conserves resources, and in particular is compatible with different spray and pump systems.

This object is achieved by the devices defined in the independent patent claims. Further embodiments emerge from the dependent claims.

An adapter according to the invention for connecting a refill container to a container during a refilling process has a first open end and a second open end. The first open end and the second open end are connected to one another with a wall, in particular a peripheral wall. A breaking element is arranged inside the adapter. This breaking element extends in the direction of the first open end and is connected on one side via a web to the wall.

This allows the arrangement of the breaking element between the first open end and the second open end, and in particular the arrangement of the breaking element within the wall, in particular centrally within the wall.

As already discussed, the breaking element is connected on one side via a web to the wall. This means that it is only connected on one side and has no further connections. This one-sided attachment has the consequence that a continuous free space is created around the breaking element, said free space extending at least along half the circumference of the wall, preferably along 75% of the circumference of the wall, and particularly preferably along 90% of the circumference.

The breaking element makes it possible to use refill containers which, for example, have a dispensing opening without a separate or openable closure, with the present adapter. In addition, such a breaking element can be provided to break open a quality seal on a dispensing opening of the refill container. Typically, refill containers often have what is known as a seal which closes off the dispensing opening. The opening or breaking open of this seal is simply enabled with a breaking element, as is presently arranged. The arrangement within the wall, in particular centrally within the wall, makes it possible to break open seals of refill containers having dispensing openings which, for example, have a smaller diameter than a corresponding inner diameter of the adapter.

The web forms a stop which prevents a dispensing opening of a refill container from being introduced too deeply into the adapter.

The extent of the breaking element from the second open end toward the first open end is not limited by the first open end. The breaking element can thus extend beyond the first open end and project from the latter at least in regions. However, the uppermost point of the breaking element is preferably arranged set back toward the first open end. This makes it possible to insert the refill container into the adapter without the seal already being broken open prematurely.

The breaking element preferably extends radially inward from the wall in the direction of a central axis of the adapter, in particular beyond it.

The central axis of the adapter is substantially defined by a connection between the first end and the second end of the adapter, in particular by a connection of the centers of gravity of the respective ends. In generic use, this central axis extends substantially along a longitudinal axis of the container through its opening or a corresponding, additionally formed refill opening.

This arrangement of the breaking element enables a simple and in particular symmetrical introduction of a force, acting on the breaking element, into the wall of the adapter.

The web via which the breaking element is connected to the wall preferably extends over at least 25% and at most over 75% of the axial length of the breaking element.

The region of the breaking element which is not connected to the web thereby projects in the direction of the first open end of the adapter. A vacancy is produced into which a wall of the dispensing opening of the refill container can be inserted.

The stated maximum values and minimum values ensure that the breaking element is fastened via the web to the wall with sufficiently high stability, and that the breaking element has a sufficiently high projection relative to the web, so that a refill container is guided in the adapter and a seal to be broken open is on the one hand reliably broken open and on the other hand is pushed into the refill container by the breaking element, so that an emptying of the refill container with no residue is possible.

The breaking element can have a flank inclined toward the central axis. The flank is in particular formed sloping down toward the central axis. In other words, as viewed in the direction of the web, the breaking element has a shorter axial extent close to the central axis than further away therefrom.

The highest point of the breaking element in the direction of the central axis is thus arranged decentrally in the adapter. The direction of the central axis corresponds to the pour direction.

An inclination of the flank on the one hand enables a seal to be broken open from one side and thus with reduced force, wherein the design of the flank sloping down toward the central axis ensures that the maximum force is introduced close to the web, and thus close to the wall, during the breaking-open process. This has the result that the leverage ratios, i.e. the force ratios, upon initially breaking open are favorable. Via the inclination of the flank, a tip is therefore formed on the breaking element. This facilitates the breaking open of a corresponding seal. In the initial breaking, the force is introduced substantially in the form of a point.

This tip simultaneously defines the highest point of the breaking element, and is thus arranged decentrally in relation to the adapter. In the radial direction starting from the central axis, the highest point is preferably situated at least after the first third of the distance between the central axis and the wall, particularly preferably after half, in particular in the last third.

Alternatively, it is possible to orient the inclination of the flank in such a way that the flank is designed to ascend toward the central axis. This orientation naturally has the result that the leverage ratios are less favorable than given the above-explained inclination. However, applications are conceivable in which a maximum force does not need to be applied in order to break open a seal.

Preferably, a cutting edge is formed on an end of the inclined flank facing toward the first opening. The cutting edge is in particular formed at the tip of the breaking element.

The cutting edge enables the simple initial penetration of the breaking element into the seal to be broken open.

The breaking element can extend, in the direction of the central axis of the adapter, over more than 50% of an open cross section of the adapter, in particular over more than 70%. If the adapter has a circular cross section, for example, the breaking element extends from the wall of the adapter up to at least the central axis, and preferably beyond it.

This embodiment leads to the effect that a seal which has been broken open is pushed into the refill container by the breaking element and thereby releases an opening which enables a simple and substantially complete emptying of the refill container.

During the breaking-open process, the broken-open seal is successively pushed through the flank into the refill container and, after completion of the breaking-open process, is fixed substantially in the vertical position by the flank of the breaking element opposite the web, i.e. the vacancy.

It can be provided that the breaking element has a sliding edge opposite the web. In other words, the flank opposite the web can be designed as a sliding edge.

The broken-open seal can slide on this sliding edge and is guided and pushed into the refill container by this sliding edge.

The sliding edge can be designed inclined relative to the central axis. The sliding edge is preferably inclined such that an angle enclosed between the sliding edge and the central axis opens in the direction of the first open end. This corresponds to an inclination opposite the flank.

Due to the inclination of the sliding edge in the direction of the flank, specific kinematics of the breaking-open process can be enforced.

An inclination opposite the flank leads to the situation that, in the fully broken-open state, the broken-open seal rests only on a single point of the breaking element, which in turn leads to the flow resistance to the liquid to be refilled being reduced.

The sliding edge and the flank preferably merge into one another via a curve.

This improves the kinematics of the breaking-open operation.

The adapter can be manufactured in one piece, in particular in an injection molding method.

The one-piece design permits a simple and uncomplicated manufacture. Adapters, as described in the present case, can be manufactured simply and cost-effectively in particular via the injection molding method.

The wall of the adapter is preferably of circular cylindrical design, and thus forms a circular ring.

The adapter can simply be inserted into correspondingly designed openings of a container.

It would thereby be conceivable that the wall is completely or partially interrupted, in particular opposite the web.

An outer diameter which is slightly larger than an inner diameter of an opening of a container can be provided on the adapter. Upon introducing the adapter into this opening, the adapter is compressed, and a preloaded connection arises between the adapter and the opening of the container.

An interruption is taken in the assessment of the length of a circumference of the wall.

The breaking element, together with the web, preferably has a flat design, wherein the breaking element has a thickness which is less than three times the thickness of the wall. The thickness is in particular less than twice the thickness of the wall.

The flat design allows a simple and cost-effective manufacturing.

The maximum limitation of the thickness of the web and/or of the breaking element ensures that this is not excessively stiff in comparison with the adapter, and excessively large jumps in the force and/or stress profile are avoided.

It can be provided that the adapter has a holding element at its first open end, wherein the holding element is designed in particular as a radially extending collar orbiting along the first end.

With the holding element, the adapter can be held in place in the opening of a container in relation to the direction of the central axis, wherein in particular the holding element is supported on a rim of the opening of the container. The holding element can comprise a plurality of individual elements, such that the holding element is supported on the opening of the container only at points.

It can be provided that the adapter is placed in the container once.

The present embodiment of the breaking element and its one-sided attachment with a web to the wall enables the adapter to be left in the container even if a pump or spray system is subsequently fastened to the container. Due to the attachment only on one side, as already described in the present instance, there is a sufficiently large free space in order to guide even tubes or connecting lines which are arranged eccentrically in the pump or spray system along past the breaking element into the interior of the container, and to rotate a fastened pump or spraying system there, for example in order to orient a spray head of such a system.

Another aspect of the invention therefore relates to a container comprising an adapter as presently described.

The subsequent introduction of an adapter into the container by the customer is omitted.

Figure 2:
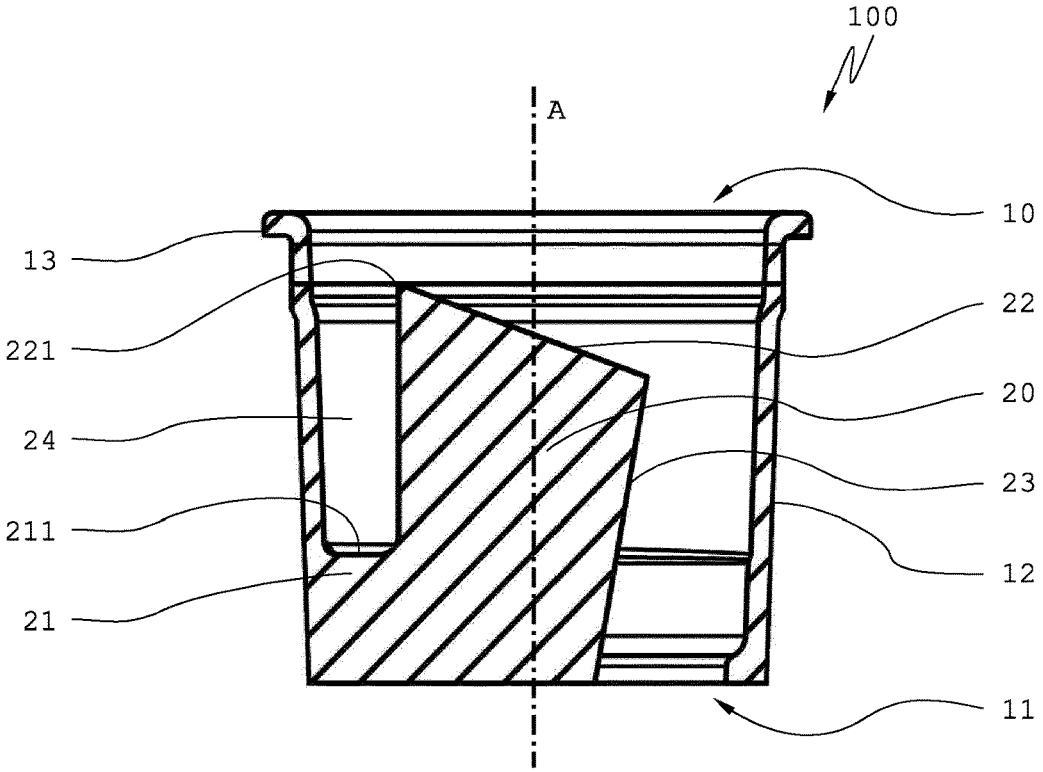
Figure 3:
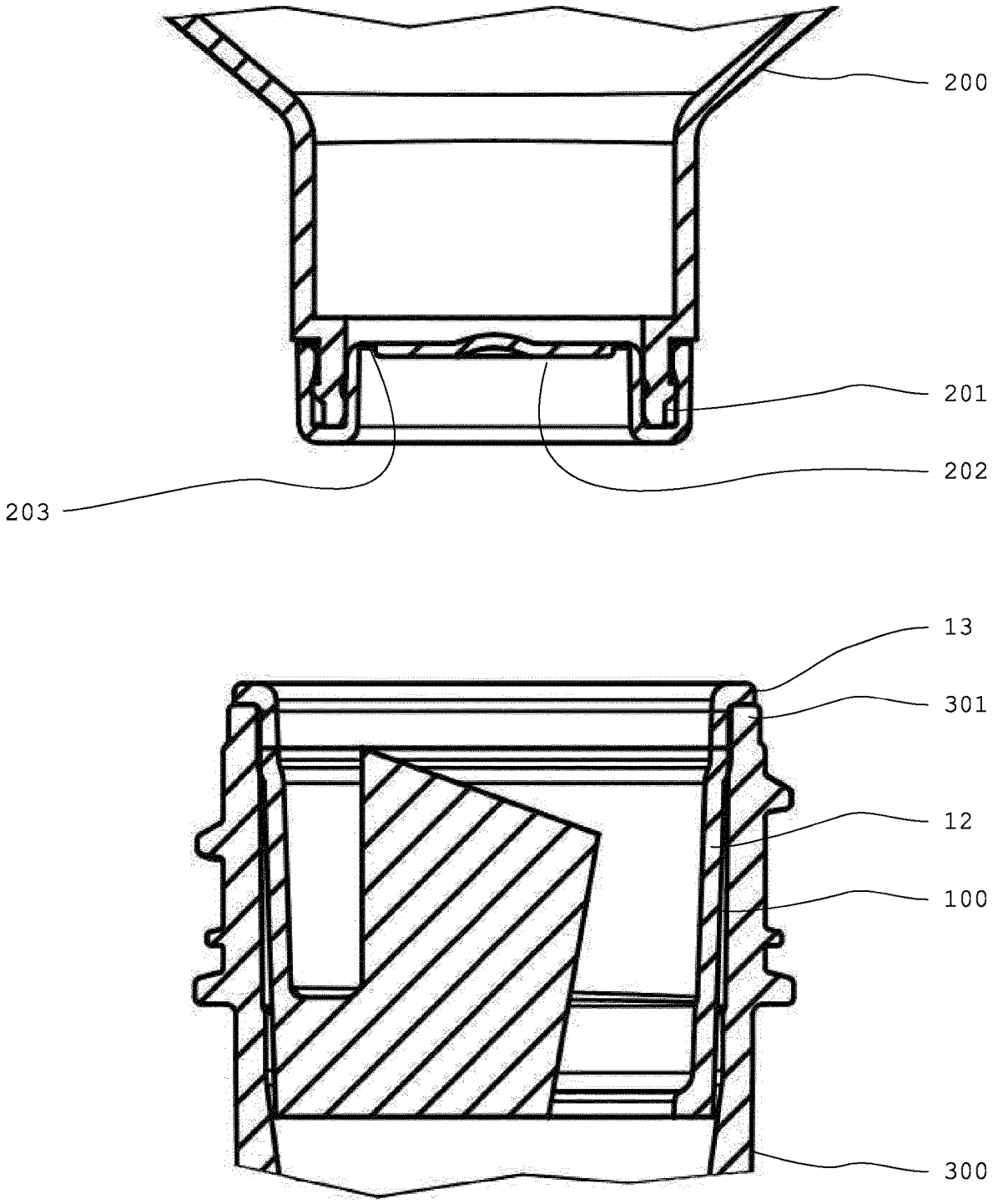
Figure 4:
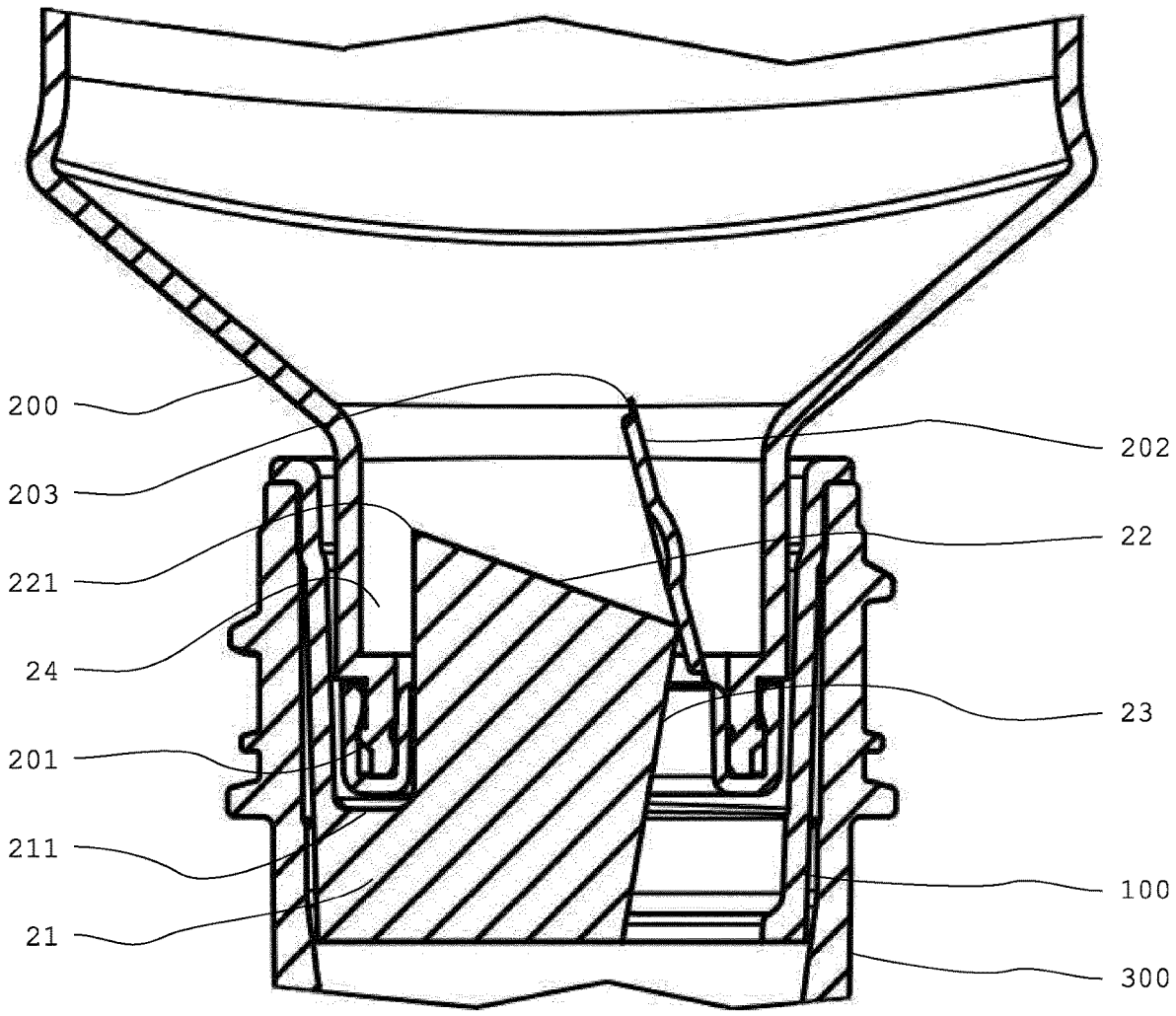

An embodiment of the adapter is explained in more detail with reference to schematic drawings. These show:

FIG. 1: a perspective view of an adapter;

FIG. 2: a vertical sectional view of the adapter of FIG. 1;

FIG. 3: a sectional view of the adapter inserted in an original container;

FIG. 4: the sectional view according to FIG. 3 after insertion of a refill container.

FIG. 1 shows a perspective view of an adapter 100. The adapter 100 has a first open end 10 and a second open end 11. The first open end 10 is connected to the second open end 11 by means of a wall 12. The wall 12 is designed as a substantially circular cylindrical sleeve, therefore has a circular ring-shaped cross section. A breaking element 20 is arranged inside the wall 12. The breaking element 20 is connected to the wall 12 with a web 21 (see FIG. 2 in this regard).

FIG. 2 shows a vertical sectional view of the adapter 100 of FIG. 1. The section extends in the vertical direction through the breaking element 20. The adapter 100 has a first open end 10 and a second open end 20. The first open end 10 has a larger diameter in comparison to the second open end 11. The circular cylindrical wall 12 is therefore conical and has an outer diameter tapering from the first open end 10 toward the second open end 11.

At the first open end 10, a holding element is formed which is designed as a radially extending collar 13 running around the first end 10.

Likewise shown in FIG. 2 is a central axis A which extends from the second open end 11 toward the first open end 10.

The breaking element 20, which extends in the direction of the first open end 10, is arranged inside the wall 12. The breaking element 20 is set back in relation to the first open end 10. This allows the guidance of a refill container in the refilling process before the seal is broken open (see FIG. 4). The breaking element 20 is connected with a web 21 to the wall 12 on one side. The web 21 extends over 30% of the axial length of the breaking element 20. The axial length of the breaking element 20 in the present instance corresponds to the largest extent of the breaking element 20 in the direction of the central axis A.

In other words, the breaking element 20 projects beyond the web 21 with approximately 70% of its length in the direction of the central axis. Together with the wall 12, this projection forms a vacancy 24 into which a corresponding wall of a refill container can be inserted.

The breaking element 20, opposite the web 21, has a sliding edge 23 which has an inclination in relation to the central axis A. The inclination of the sliding edge is, in the present instance, such that an angle between the sliding edge 23 and the central axis A opens in the direction of the first open end 10.

In the direction toward the first open end 10, the breaking element 20 terminates with a flank 22 which ends in a tip 221 in the direction of the web 21. The tip 221 can be designed as a cutting edge. In the present instance, the flank 22 is designed inclined relative to the central axis A. In the present instance, the inclination drops toward the central axis. In other words, this means that an angle that is acute, i.e., smaller than 90°, is formed between the flank 22 and the central axis, on the side of the web 21.

In this configuration, a vertex, not designated more specifically in the present instance, is formed between the flank 22 and the sliding edge 23, which vertex is arranged farthest away from the web 21 in the radial direction. When used as intended, this vertex enables a specific guidance of a seal to be broken open (see FIG. 4 in this regard).

FIG. 3 shows a sectional view of the adapter 100 inserted into an original container 300. Additionally, in FIG. 3 a refill container 200 is shown which has a dispensing opening 201 which is closed with a seal 202. In the present instance, the seal is designed as a cap spanning a rim of the dispensing opening 201 and is pressed onto the refill container 200. A material thin point 203 is formed on the seal 202 and, in the present instance, runs along the periphery of the seal 202.

The adapter 100 is inserted into an opening 301 of the container 300. The adapter 100 rests with its collar 13 on an end of the opening 301. In the region of the collar, or directly adjacent to the collar 13, the wall 12 of the adapter 100 has a diameter which is slightly larger than an inner diameter of the opening 301. With the introduction of the adapter 100 into the opening 301 of the container 300, the adapter 100 is thus pressed into the opening 301 and is held securely in this opening. The adapter 100 can therefore remain within the opening 301 of the container 300. As can be seen, for example, from FIG. 1, the cross section of the opening 301 remains almost completely free, with the exception of the thickness of the web 21 or of the breaking element 20, even after the adapter 100 has been introduced. A pump or spray system attached to the container 100 again after the refilling process can therefore be arranged on the container 100 without significant restriction.

FIG. 4 shows the sectional view according to FIG. 3 after insertion of a refill container 200. In other words, the refill container 200 shown in FIG. 3 has been moved in the direction of the container 300. The refill container is thereby guided from the beginning by the wall 12 of the adapter, and the contact between the tip 221 and the seal 202, and in particular the material thin point 203, occurs with a delay. The material thin point 203 is broken open by continued movement of the refill container 200 in the direction of the container 300. A wall, not designated more specifically, of the dispensing opening 201 of the refill container 200 is inserted into the vacancy 24. During the insertion, the seal 202 is pushed open further by the flank 22, and the thin point 203 is gradually torn open. The refill container 200 is moved in the direction of the container 300 until an end of the dispensing opening 201 rests on the stop 211 of the web 21. During this process, the seal 202 is pushed open until it is oriented almost parallel to an inner wall of the refill container 200 and/or to the central axis A of the adapter 100. Depending on the position of the vertex (not designated more specifically) between the flank 22 and the sliding edge 23, the now pushed-open seal 202 is held more or less parallel to the central axis A.

By tearing or breaking open the seal 202, the dispensing opening 201 of the refill container 200 is unblocked. The material to be refilled, such as a liquid, can now flow from the refill container 200 into the container 300.

After the refilling process, the refill container 200 is correspondingly removed again. The adapter 100 can remain in the container 300.

The invention claimed is:

1. An adapter (100) for connecting a refill container (200) to a container (300) during a refilling process, the adapter (100) comprising:

a first open end (10) and a second open end (11), wherein the first open end (10) and the second open end (11) are connected to one another with a peripheral wall, wherein a breaking element (20) is arranged inside the peripheral wall, wherein said breaking element (20) extends in a direction of the first open end (10) and is connected on one side via a web (21) to the peripheral wall such that free space is created around the breaking element, said free space extending at least along half the circumference of the peripheral wall and the adapter (100) has a holding element at the first open end (10), wherein the holding element is designed as a radially extending collar (13) which extends radially from the first open end (10).

2. The adapter (100) according to claim 1, wherein the breaking element (20) extends radially inward in a direction of a central axis (A) of the adapter (100).

3. The adapter (100) according to claim 1, wherein the web (21) extends over at least 25% and at most 75% of the axial length of the breaking element (20).

4. The adapter (100) according to claim 1, wherein the breaking element (20) has a flank (22) which is inclined toward a central axis (A) of the adapter (100), wherein the flank (22) is designed to slope down in a direction of the central axis (A).

5. The adapter (100) according to claim 4, wherein a cutting edge is formed on an end of the inclined flank (22) facing toward the first open end (10).

6. The adapter (100) according to claim 1, wherein the breaking element (20) extends over more than 50% of an open cross section of the adapter (100).

7. The adapter (100) according to claim 1, wherein the breaking element (20) has a sliding edge (23) opposite the web (21).

8. The adapter (100) according to claim 7, wherein the sliding edge (23) is inclined relative to a central axis (A) of the adapter (100).

9. The adapter (100) according to claim 7, wherein the sliding edge (23) and a flank (22) of the breaking element (20) merge into one another via a curve (R).

10. The adapter (100) according to claim 1, wherein the adapter is manufactured in one piece in an injection molding method.

11. The adapter (100) according to claim 1, wherein the peripheral wall is circularly cylindrical.

12. The adapter (100) according to claim 1, wherein the breaking element (20), together with the web (21), has a flat design, wherein the breaking element (20) has a thickness which is less than three times the thickness of the peripheral wall.

13. A container (300) comprising an adapter (100) according to claim 1.

* * * * *